United States Patent [19]

Löhl

[11] 4,003,450

[45] Jan. 18, 1977

[54] SMALL STRUCTURAL BUILDING COMPONENT

[75] Inventor: Walter Löhl, Heilbronn, Germany

[73] Assignee: Kenngott GmbH & Co. KG, Germany

[22] Filed: Apr. 23, 1975

[21] Appl. No.: 570,775

[30] Foreign Application Priority Data

Apr. 25, 1974 Germany ..... 2419949

[52] U.S. Cl. ..... 182/194; 182/228; 52/189

[51] Int. Cl.[2] ..... E04F 11/14

[58] Field of Search ..... 182/228, 46, 194; 52/189, 223 R, 223 L, 514, 720, 723, 743; 264/228, 271

[56] References Cited

UNITED STATES PATENTS

| | | | |
|---|---|---|---|
| 1,883,196 | 10/1932 | Wertz | 52/514 |
| 2,671,158 | 3/1954 | Rubenstein | 52/223 R |
| 2,921,463 | 1/1960 | Goldfein | 52/223 R |
| 3,150,032 | 9/1964 | Rubenstein | 52/223 R |
| 3,172,932 | 3/1965 | Heyden | 52/723 |
| 3,204,416 | 9/1965 | Williams | 52/743 |
| 3,226,894 | 1/1966 | Buchardt | 52/223 L |
| 3,533,203 | 10/1970 | Fischer | 52/223 R |
| 3,676,968 | 7/1972 | Campbell | 52/223 R |
| 3,820,832 | 6/1974 | Brandestini | 52/223 L |

FOREIGN PATENTS OR APPLICATIONS

| | | | |
|---|---|---|---|
| 230,607 | 12/1963 | Austria | 52/189 |
| 1,509,586 | 8/1965 | Germany | 52/189 |

*Primary Examiner*—Reinaldo P. Machado
*Attorney, Agent, or Firm*—Robert E. Burns; Emmanuel J. Lobato; Bruce L. Adams

[57] ABSTRACT

A small reinforced structural building component, in particular a step, comprises a solid block of rock or the like with at least two longitudinal bores and at least one transverse bore intersecting the longitudinal bores, and reinforcing means extending throughout the system of bores. The reinforcement may comprise metal rods, wire rope, glass rovings, or glass fiber-loaded plastics, and pre-stresses the block.

27 Claims, 11 Drawing Figures

SMALL STRUCTURAL BUILDING COMPONENT

BACKGROUND OF THE INVENTION

The invention relates to a small reinforced structural building component. The purpose of such small structural components is on the one hand to perform a load-bearing function and on the other hand to contribute to the architectural shape of the building structure. Accordingly, they should be constructed of natural rock or other materials with similar properties, for example Agglo marble or similar compound materials containing natural rock constituents and having the appearance of natural rock. They are installed without being covered, or concealed under plaster, or clad; so that they have to fulfil stringent requirements regarding their appearance. Components of this kind are used more particularly as steps on stairways where they are often exposed to particularly high stresses and where very special safety requirements must be met. They can however also be used for other purposes, such as landing slabs, other cover plates, wall lintels or as other parts similarly arranged and loaded.

The German Gebrauchsmuster 1 994 136 discloses stairs in which supporting bars extend through the steps of natural stone. It is the intention in that case to economize valuable natural stone and to transfer the entire support function to horizontal support members, more particularly since the natural stone cannot be heavily stressed in bending. It is a disadvantage of this prior construction that the support members must project from both endfaces of the treads in order to form the supporting structure. Many cases call for a structural component, more particularly a step, in which the reinforcement is not visible.

The German Offenlegungsschrift No. 1 683 539 proposes a partial solution in which steel ties of cantilevers are inserted from below into slots disposed in steps of natural stone, secured on one side, the steel ties being then stressed in openings applied from below. This construction calls for a high manufacturing cost and the reinforcement structure is visible on the underside or requires covers; these have to be separately inserted into the slots, are always visible and are therefore often not desired by the user and the architect.

Small structural components which, on the one hand, must have a reliable load-bearing capacity to absorb appropriate loadings and on the other hand are required to have the appearance of unmodified natural stone at least on four or five sides, are required in many applications in order to provide adaptation to other natural stone claddings in the building structure or because of the requirements of the owner of the building. Natural stones or natural stone pieces in compound materials the structural components of which are cut from larger blocks, frequently contain fine hair cracks. They cannot therefore be used as load-bearing parts without reinforcement, more particularly they cannot be used in this way for stairs in which the steps form component parts of the load-bearing structure. Structural components of other materials which are cut from blocks also require reinforcement when they function as load-bearing parts. Longitudinal and transverse reinforcement must be provided for torsional stresses. The installation of such reinforcement should not substantially increase the cost of such structural components.

It is the object of the invention to provide such a structural component which can be provided in simple manner with reinforcement, installation of the said reinforcement being either not recognizable or being recognizable only at unimportant places.

SUMMARY OF THE INVENTION

The invention resides in a small structural building component of styled shape, comprising a block of natural rock or material which presents the aforementioned, styled or architectural appearance. It contains at least two longitudinal bores interconnected by at least one transverse bore, and reinforcing means extending through the longitudinal and transverse bores. Unitary reinforcement means which extend through the longitudinal bores and the transverse bore and thus also reliably take up transverse stresses, can be used because of the provision of the transverse bore. The said reinforcement can bear at least partially on the corners formed by the intersecting bores, on elements inserted thereat, or on the side wall of the transverse bore, whereby an invisible abutment for supporting the reinforcement is provided, permitting the application of prestress, which can be substantial or quite small.

Prestress in the transverse direction can also be applied if a plurality of transverse bores are provided. An internal spatial reinforcement structure can be installed in the natural rock or the like if a plurality of bores are provided. The prestress also compresses any fine hair cracks. Accordingly, these will be no longer visible and will no longer tend to spread to form larger cracks and fractures.

As a rule the bores will be open only on one endface but in special applications the bores or recesses can be open on larger surfaces of the structural components thus facilitating the production of the recesses. The bores extend from the surface which gives the least rise to objections to the presence of openings which may have to be subsequently closed. The longitudinal bores in steps therefore extend from the end of the step which is set into or faces the staircase wall in the installed state, and the transverse bores extend from the rear of the steps.

Reinforcement can be applied in many different ways, for example by means of a steel rod structure assembled in the interior by means of flash-butt welding. In many cases, more particularly if only two longitudinal bores with one transverse bore are sufficient for the reinforcement, it is appropriate to pull in a wire rope as reinforcement and to stress the said wire rope. The wire rope can be easily threaded through and applies the required prestress without difficulty. If more than two longitudinal bores are provided, two wire ropes may be accommodated in one of these bores, the two wire ropes diverging at the end of this bore into different portions of the transverse bore. It is also possible to use wire ropes or steel rods with eyelets provided on the inner end, a transverse bar inserted into the transverse bore extending in each case through the said eyelets. Rope slings or eyelets attached to or formed on ropes or bars can also be supported on transversely inserted sleeves. Sleeves of this kind are required for attaching the spacer bolts in some known stair constructions. Prestress can be easily applied to the required magnitude by means of tensioning screws and nuts.

A plastics material may be provided to fully fill the bores to provide a good bonding and adhesion of the reinforcement inserts over the entire length. Said plastics compound also fills small pores and said plastics compond engages in the said pores or in cracks. Plastics shrink on curing; this enables an additional prestress to be applied as will be described hereinbelow for the other kind of reinforcement.

The use of steel bars or wire ropes always leads to a special preference for one stressing direction, namely the longitudinal direction of such reinforcements of high load-bearing capacity. Furthermore, installation of steel reinforcement during manufacture is relatively expensive. Substantial manufacturing advantages are obtained if the reinforcement comprises glass silk strands or glass silk rovings embedded in plastics, because these can be introduced more readily into the bores and guided around the corners. For example, they can be pulled through the bores by means of a thin wire which can be easily threaded through and the plastics compound is introduced thereafter when the natural shrinkage of said plastics again results in the application of a corresponding prestress.

It is however possible to dispense entirely with pulling in and inserting separate reinforcing strands or bars by providing as reinforcement a plastics filling with cut glass silk or short glass silk fibres embedded therein in random configuration. These substances can be mixed with each other outside the structural component and can then be injected by means of a press so that all cavities in the component are filled. Shrinkage of the plastics then automatically applies the prestress. The glass silk fibres of appropriate length, in the case of short glass silk fibres only approximately 1 mm, but in some cases longer up to approximately 10 to 15 mm, result in a substantial reinforcement of the plastics material so that the compound material results in spatial stressing and reinforcement of the entire structural component, particularly if the plastics material completely fills the bores, so that a natural rock or the like can be used as load-bearing component without the risk of cracks, even under overloads, but without anything of the reinforcement being visible except small openings on the appropriate endfaces, such openings being closed. Only a small amount of manual labour is required. Mass production is possible even for changing component shapes because it is not necessary for reinforcing bars of different lengths to be provided with screw-threading or for ropes of different length to be provided with approprate attachment means.

The plastics must be selected in accordance with the intended use, the main feature being the shrinkage on curing and elongation; due allowance must also be made for the filler and more particularly for the compression characteristics of the material of the structural component and the shrinkage and elongation characteristics of the plastics material.

If the reinforcement extends through two longitudinal recesses and two transverse recesses, where appropriate in the form of transverse bores, it will be possible to produce a structural component capable of absorbing large forces in several directions and more particularly capable of absorbing torsional forces because it is possible in such structural components to obtain rectangular reinforcement with slight effort, such reinforcement permitting the components to be incorporated in a spatial load-bearing structure which applies torsion. Instead of a second transverse bore, it is possible for a transverse recess for the reinforcement simply to be milled in the endface, thus reducing the manufacturing cost.

It is possible to provide the corners of the bores with sleeves or other elements to which large forces can be applied without difficulty and these forces can then be transmitted directly to the reinforcement. Furthermore, the reinforcement bears well on such elements in the interior of the structural components. Elements of the kind described above, such as sleeves or the like, may extend through the structural component in substantially larger bores. It is also possible for them to extend at one end only to within a short distance of one surface. This enables bolts and the like to be readily connected.

Preferably, and particularly for steps, the or each transverse bore is open only at the rear of the component, which is usually in the shadow so that the opening preferably closed by a plug of the same material as the rest of the component is hardly visible.

If a plastics filling is used, it can be emplaced with the longitudinal bores vertical, so that it thoroughly displaces the air on entering the bores and is therefore particularly free of pores and provides high tensile strength. The plastics material can alternatively be injected through a transverse bore, the component being placed vertically with the longitudinal bores open at the top so that the plastics material rises properly in all bores. If it rises more rapidly in one bore than in the other, the latter can be closed with a plug after being completely filled. Polyester resins form a good bond with the reinforcement inserts and with natural rock. They are also moderately priced and have favourable shrinkage characteristics. The plastics materials can be mixed with fillers, for example chalk or quartz meal, in order to prevent cracking.

Structural components according to the invention are particularly suited as steps and as stair landings, because many of the steps used to the present time are subjected to high stresses, more particularly torsional stresses, and principal tensile forces applied at an angle of 45° To the front or rear edge of the step; such forces require the insertion into the steps not only of longitudinal reinforcements but also of transverse reinforcements, a feature which was not possible in conventional steps constructed of single blocks cut from natural rock or other materials.

Embodiments of the invention will now be explained with reference to the accompanying drawings, in which.

Throughout the drawings, corresponding parts are identified by the same references.

Figure 1:
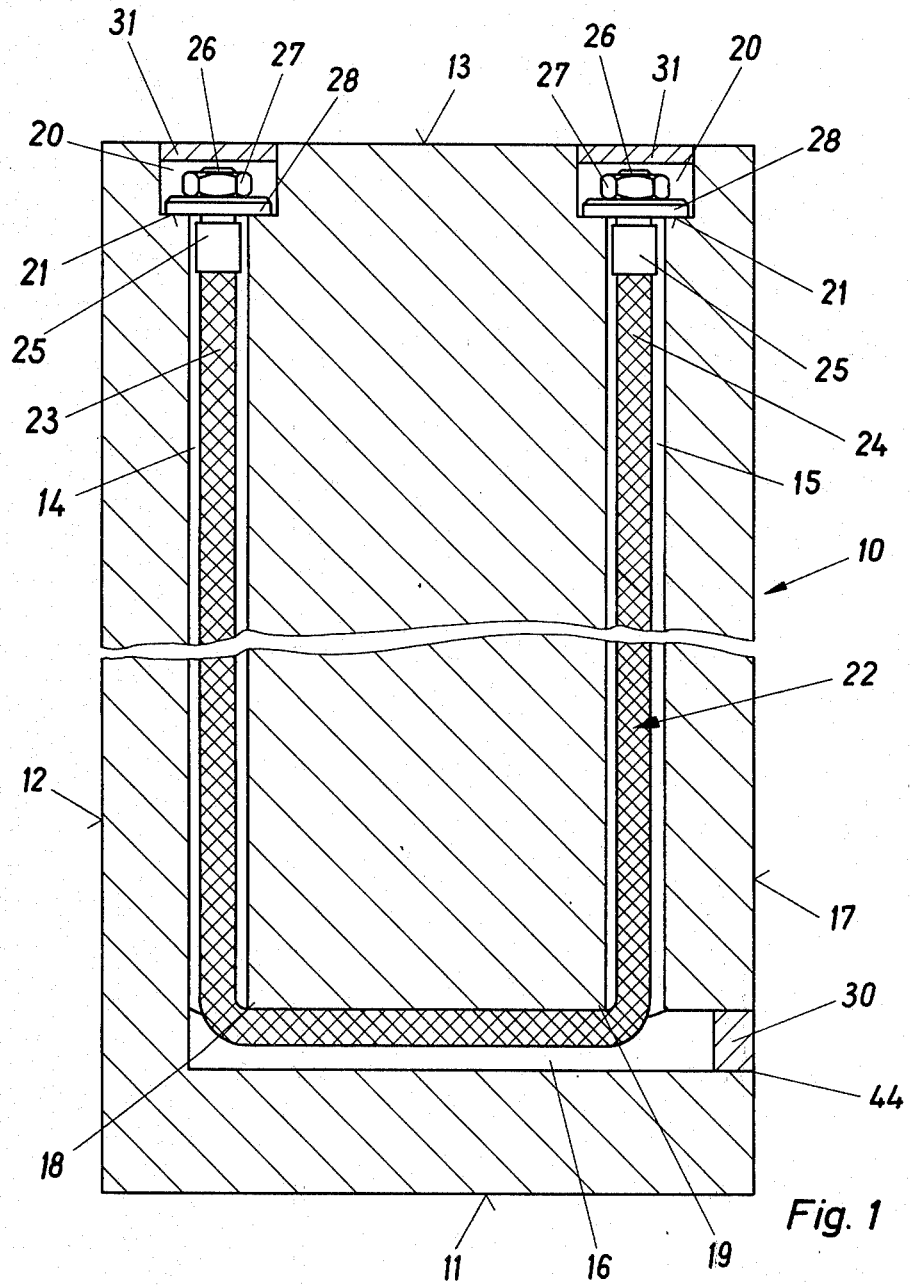
FIG. 1 is a horizontal section through a first embodiment of a step, with wire rope reinforcement.
Figure 3:
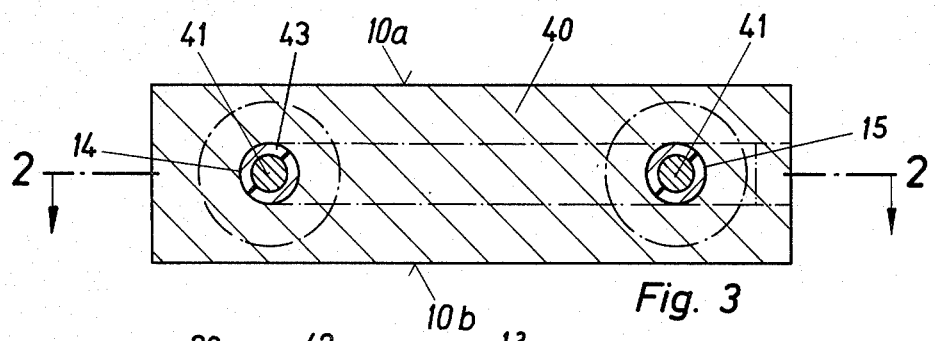
FIG. 3 is a vertical section along the line 3—3 through the step according to FIG. 2.

The step 10 shown in FIG. 1 comprises a monolithic piece of natural rock, for example marble. Such material, and therefore the step schematically shown in the drawing, frequently has hair-line cracks, as already indicated. These are often of microscopic size, therefore they are not shown in the drawing. The top surface 10*a* and the bottom surface 10*b*, of step 10 which are not visible in FIGS. 1 and 2 but are shown in FIG. 3, are completely imperforate. One of the two end faces 11, which will subsequently face away from the staircase wall, is also imperforate. The front side 12 is also completely imperforate. Two spaced cylindrical longitudinal bores 14 and 15 extend into the block from the second end face 13, which will be subsequently recessed into or face the staircase wall. It is not necessary for these bores to be cylindrical, but they are usually provided as cylindrical bores with conventional rotating tools; other cross-sections can be selected for the bores by using other boring methods. The bores 14 and 15 terminate at a distance from the end 11, in a transverse bore 16 which extends from the rear side 17 of the step to the longitudinal bore 14 where it forms a corner 18. A corner 19 is formed with the longitudinal bore 15. As shown in FIG. 1, the open ends of bores 14 and 15 have expanded zones 20 which form shoulders 21. A wire rope 22 is threaded into the bores 14, 16 and 15 to reinforce the step. Both end portions 23 and 24 of the wire rope as shown are inserted in connecting members 25. These have screwthreaded studs 26 secured thereto, longitudinally thereof on which are threaded pre-stressing nuts 27 which bear through washers 28 on the shoulders 21. The nuts 27 are tightened to the torque which corresponds to the desired prestress. The rope 22 will then apply prestress to the natural rock along the step and also in the transverse direction in the zone adjacent to the bore 16 so that hair-line cracks are compressed, as already mentioned and that accordingly the step can be highly loaded and can thus be employed as a load-bearing component.

The bores 14, 15 and 16 can be filled with a plastics mass to fill the spaces which retain the rope in the bore walls but this is not absolutely necessary. The transverse bore 16 is usually closed with a plug 30 comprising the same material as the rest of the step 10. If desired, more particularly if the end 13 is visible, the bores 14 and 15 will also be closed with plugs 31 in their expanded zones. The plugs are appropriately adhesively fixed by means of an adhesive material of the same colour.

Figure 2:
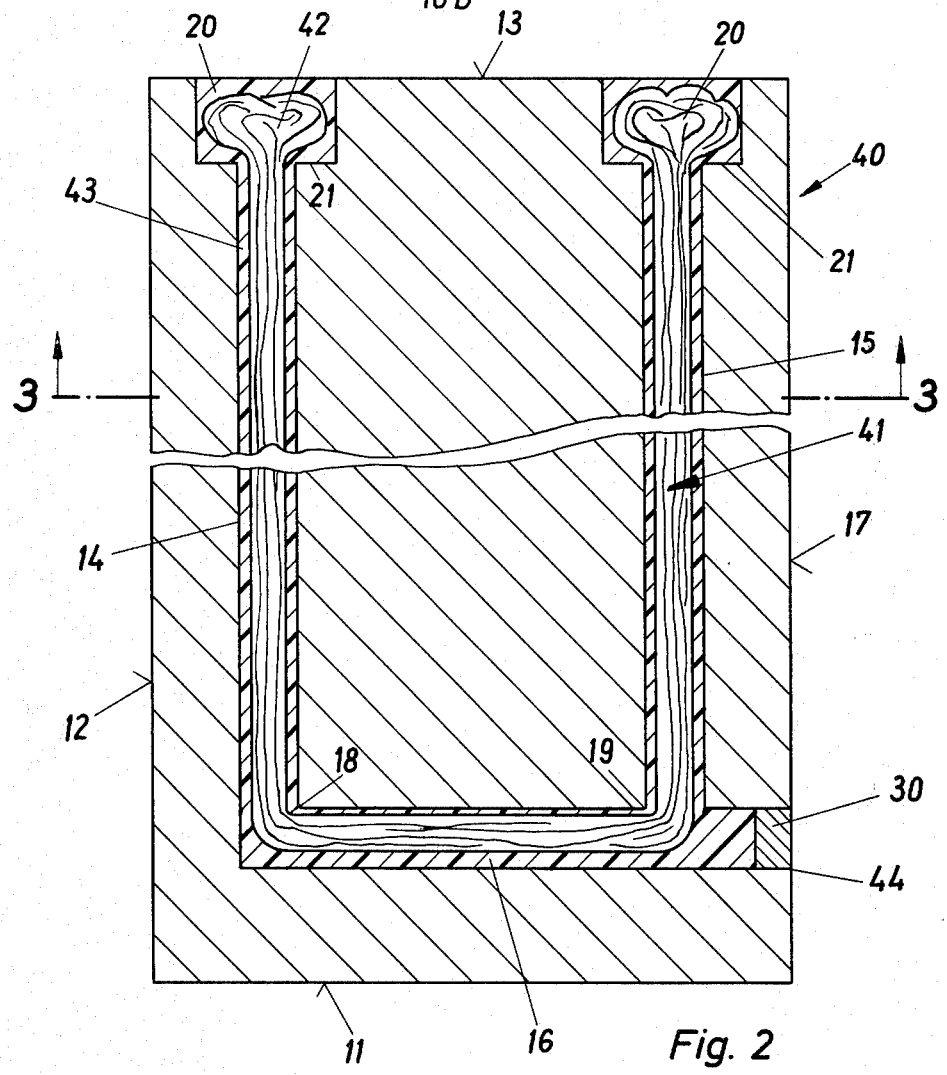
FIG. 2 is a horizontal section on line 2—2 of FIG. 3, of a further embodiment of a step reinforced with glass silk rovings.

The embodiment of FIGS. 2 and 3 shows a like drilled step 40, with identical bores. The bore boundaries disposed in front of and behind the sectional plane 3—3 are shown in dash-dot lines in FIG 3.

In this embodiment a body or strand or roving of glass silk fibres instead of a wire rope is drawn into the bores 14, 16 and 15 to extend therethrough without interruptions and to form the reinforcement. The glass silk strand comprises spun glass silk filaments combined in a suitable number approximately parallel to each other to form a strand; it is not necessary for all spun filaments have the same length. Another form of glass silk or other fibre strand, always with appropriate tensile strength and desirably with wetting capacity for plastics material 43 could also be drawn in. The ends 42 of the glass silk rovings 41 are coiled in the expanded zones 20 so as to provide good anchoring. Where appropriate it is possible for the glass rovings to be wedged at that position. If deemed appropriate by virtue of the plastics material employed, the glass silk rovings may be pre-impregnated with a suitable plastics material before being drawn into the bores. The glass rovings can be drawn into the bores for example, by means of a wire previously threaded through and which is easily movable in the bores. Thereby it is possible to perform this work more readily than the threading up of a wire rope. The spaces surrounding the glass silk rovings 41 in the bores 14, 15 and 16 are completely filled with plastics material 43, more particularly with a polyester resin, said plastics material being emplaced so that all air is displaced from the bores by virtue of the filling operation. To this end, the step or other component will be placed so that the longitudinal bores are vertical, and the plastics is poured into a longitudinal bore, for example the bore 15, after the aperture 44 of the bore 16 has been closed by means of the plug 30. The plastics will then also rise in the bore 14 while displacing all air therefrom and throughly fill the spaces. It is also possible to extract the air in order to avoid pores. Alternatively it is possible to inject the plastics through the aperture 44 as will be described for FIG. 4.

The plastics mass 43, which is preferably based on a two-component plastics such as the polyester resin, has a natural shrinkage which occurs on curing. This causes the relatively long plastics glass silk strands to tend to shorten in the bores 14 and 15. Natural rock material has only a slight compressibility so that the shrinkage produces prestress in the rock. The plastics and glass silk strands are thus well retained in the expanded zones 20, and bear on the rock material in the bore 16, through the corners 18 and 19 to produce a prestressed component. To this end, curing shrinkage and elongation characteristics of the plastics material are advantageously matched to the compression characteristics of the natural rock or other material, so that the plastics strands do not break but permanently apply the desired prestress. Where appropriate, the plastics can be mixed with suitable fillers, for example chalk or quartz sand, to influence the shrinkage characteristics. It is also important to ensure good wetting between the plastics and the glass fibres on the one hand and the plastics and the natural rock on the other hand. The plastics penetrates into pores and into the hairline cracks of the natural rock, fills these, thereby anchors itself in the bore wall, and on the other hand adhesively joins small cracks, which are also pressed together when the strands shrink. Thus the detrimental action of such cracks on the structural component is mitigated.

Depending on the material of the natural rock, the particular application of the structural component and the resultant stresses which must be absorbed by the structural component and its reinforcement, it may not be essential for the glass silk rovings to be anchored in the expanded zones of the bores: The rovings can simply project from the bores during manufacture, and after the plastics material is filled in and cured the projecting ends are cut off where appropriate, the plastics providing the necessary anchoring. A plurality of bores, longitudinal as well as transverse, can be drilled and can be appropriately filled with glass silk rovings and then with plastics if deemed appropriate by virtue of the shape of the structural component.

Figure 4:
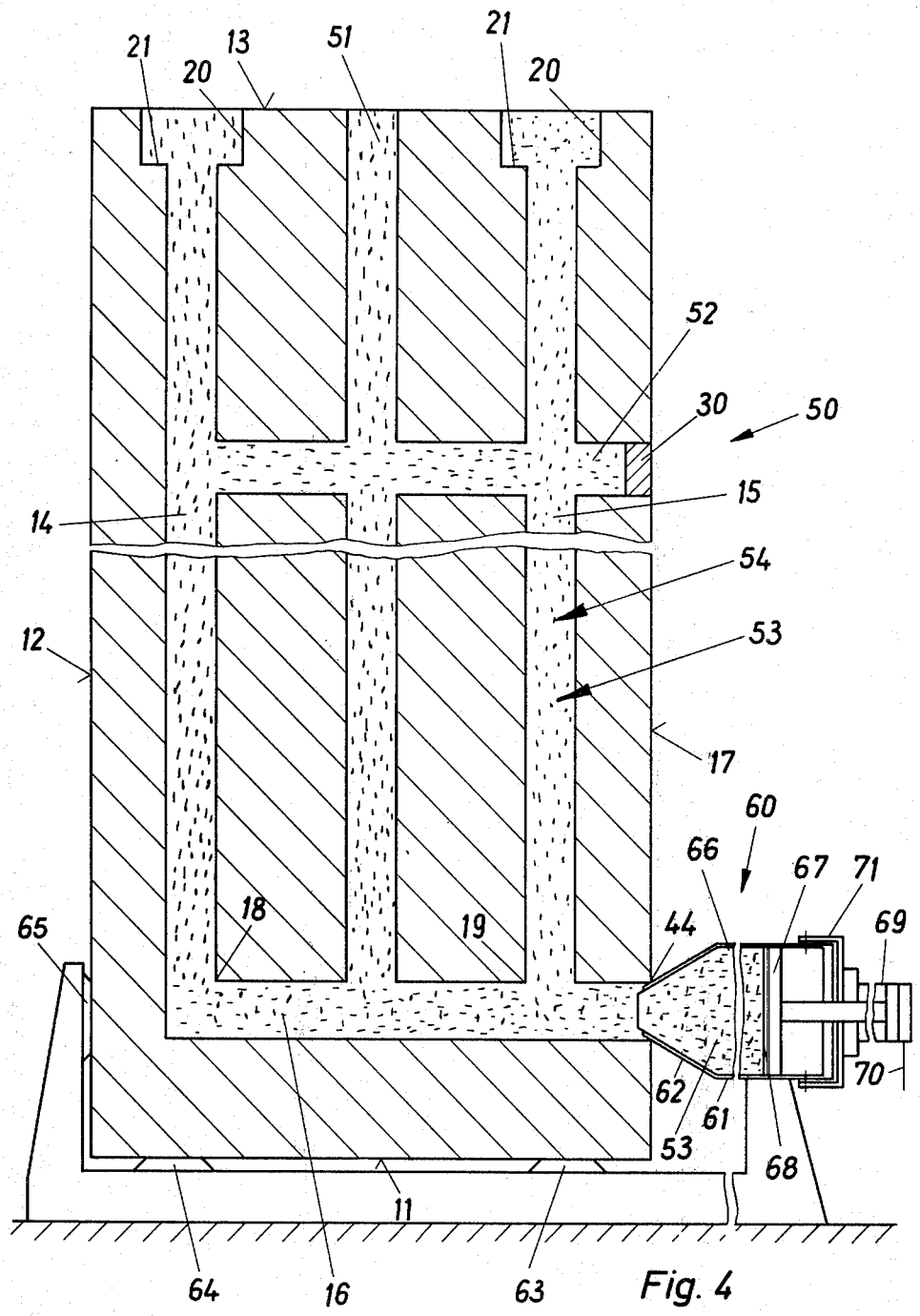
FIG. 4 is a section though a further embodiment of a step, the step being shown standing on end in a device for filling in plastics material.

The embodiment illustrated in FIG. 4 is a step 50 having the same bores as the steps of the first two embodiments but also provided with additional bores, the longitudinal bore 51 and transverse bore 52. In this embodiment no rods or strands are drawn into the bores, but a plastics material 53, loaded with short glass fibres 54, is filled into the bores. To this end, it is advantageous to use short glass silk fibres, these having an undefined length of approximately 1 mm and comprising so-called "cut glass silk" obtained by methods other than cutting spun glass silk filaments split into individual fibres, or spun glass silk filaments cut to a specific length. The plastics material 53 previously mixed with glass fibres 54 is injected into the bores, for example by means of the illustrated injecting device 60. The latter comprises, a cylinder 61 provided with a nozzle 62 which is applied to the aperture 44 of the lower transverse bore 16, the step 50 being stood on end on the supports 63 and 64; injection thrust is absorbed by an abutment 65. A disposable cartridge 66 is filled with the plastics material. A ram 67 thrusts on a disposable thrust plate 68. Said ram, after being locked in position by means of a union nut 71, is advanced by means of a pneumatic cylinder 69 which is pressurized through a duct 70. A material which cures relatively rapidly can thus be used. The amount of plastics fill is defined by the volumes of the bores 14, 15, 16, 51, 52 which have to be filled. Structural components of different shape and with bores of different size and different configuration can thus be rapidly and inexpensively provided with good reinforcement. Shrinkgage of the plastics material, which is matched to the elasticity of the rock, or other material of the component, again leads to prestressing of the entire component. Since it is not necessary for any glass or other strands to be drawn in, it is easily possible to produce a spatial reinforcement structure with a substantial number of bores which are filled with the reinforcing material. Filling with glass fibres results in reinforcement which is very similar to that of steel but can be applied much more readily. Reinforcements of larger structural components an also be applied in several planes. Only a few positions of the structural component are provided with the apertures of the bores and these can be readily closed. The production of the new self-supporting internally reinforced monolithic structural components having the appearance of a natural rock is much simpler than the process of covering load-bearing cores with natural rock panels or introducing a load-bearing core into a shell of natural rock panels.

Figure 6:
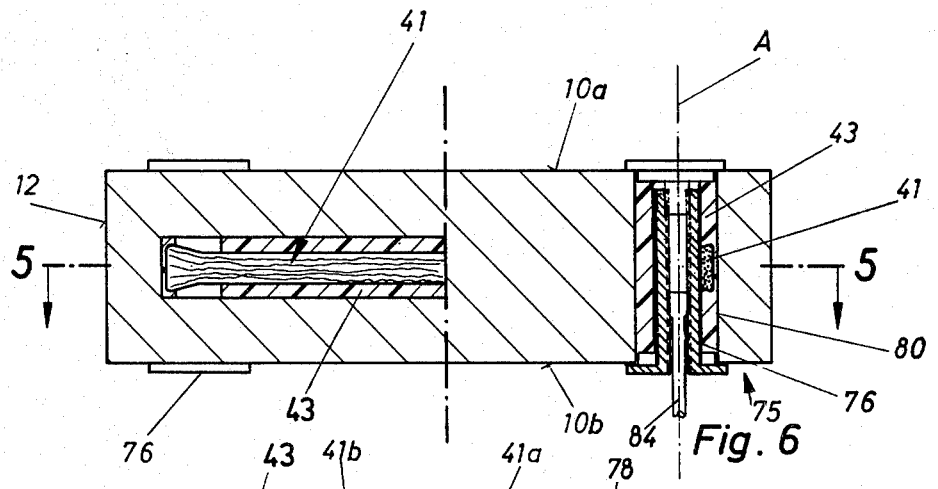
FIG. 6 is a vertical section along the line 6—6 in FIG. 5 or FIG. 7.
Figure 5:
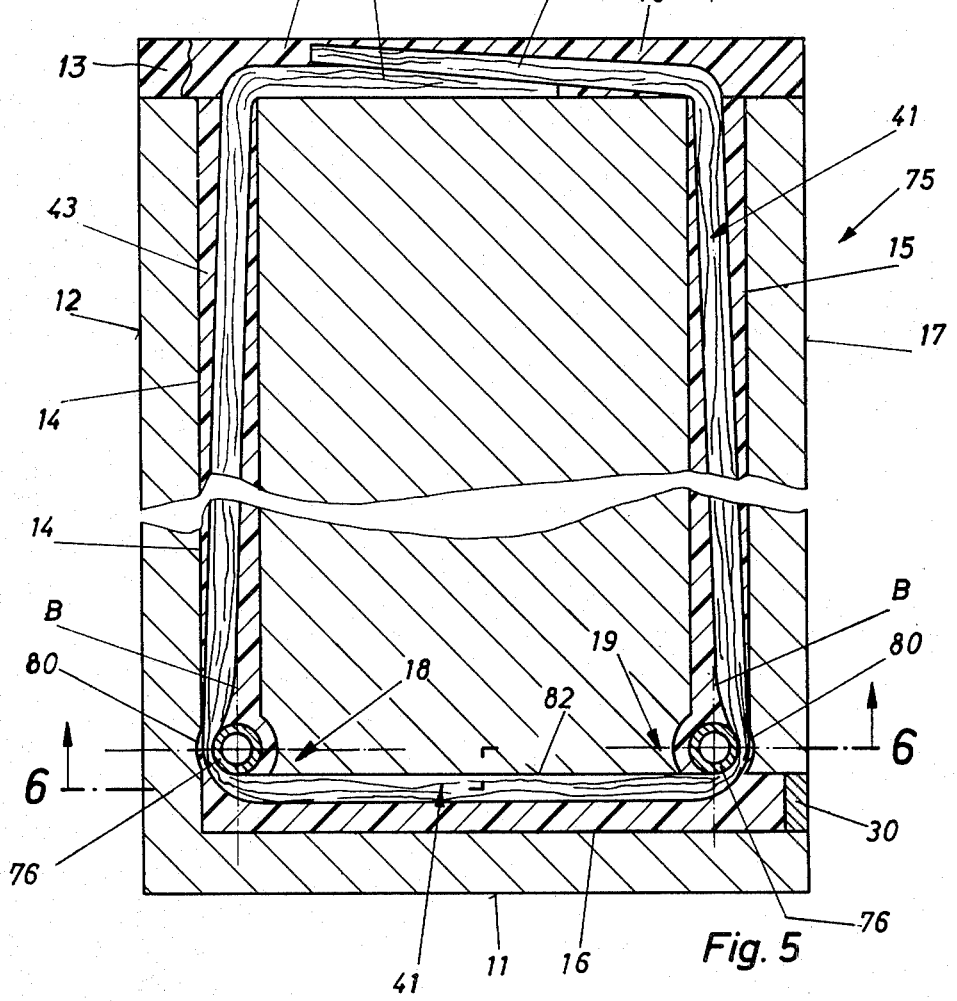
FIG. 5 is a horizontal section on line 5—5 of FIG. 6, through a further embodiment of a step with two inserted sleeves.

FIGS. 5 and 6 show a step 75 which is generally similar to that of the embodiment illustrated in FIGS. 2 and 3, but differs mainly in two respects, from the previously described embodiments. On the one hand, sleeves 76 are provided and on the other hand, a slot 78 is provided in the end 13 of the step nearest to the wall, which slot extends transversely of the step over the entire length of the end 13, to receive the ends 41*a* and 41*b* of the glass silk rovings, which overlap as shown diagrammatically, although the fibrous ends would in actual fact assume a shape somewhat different from that shown. The slot 78 with the ends 41*a* and 41*b* of the glass silk rovings 41 , therein is filled with the plastics material 43. Transverse reinforcement is thereby also provided at this end of the step. The step can therefore be subjected to very high torsional loadings without breaking. Steps of this kind can be employed for stairs in which the individual steps are connected to each other by means of spacer bolts 84. These bolts are screw-mounted into sleeves in order to provided vertical equalization and good anchoring and transfer of forces. In the step of FIGS. 5 and 6 the sleeves are joined to the reinforcement in a very simple manner. Large bores 80 extend from the top surface 10*a* to the bottom surface 10*b* of the step in the region into which the bolts are to be screwmounted. The diameter of these bores 80 should be larger than the diameter of the bores 14, 15 and 16. This is necessary on the one hand to accommodate the sleeve cross-section and the glass silk rovings 41 and the plastics material, and on the other hand to compensate tolerances which are often unavoidable when drilling the long bores 14 and 15. The bores 80 are arranged so that their axes A intersect the axes B of the bores 14 and 15, while the bores 80 are so arranged with respect to the transverse bore 16 that the internal edge 82 of the bore 16 represents a tangent to the external surfaces of the sleeves 76 and the glass silk rovings therefore bear thereon tangentially. This position of the bores and sleeves and of the glass silk rovings or the like ensures easy and reliable threading of the rovings 41 and a favourable position of the latter, even in the presence of tolerances and if the drill used to make the bores is slightly mis-aligned in the case of long bores; it also ensures thorough and intimate joining of the parts which absorb the principal forces when the plastics material is filled into the bores and has cured, after the insertion of the sleeves and threading up of the rovings. The spacer bolts 84 can be screw-mounted in known manner into the sleeves 80. The sleeves can also be constructed in other manner, depending on the particular application and materials employed.

Figure 7:
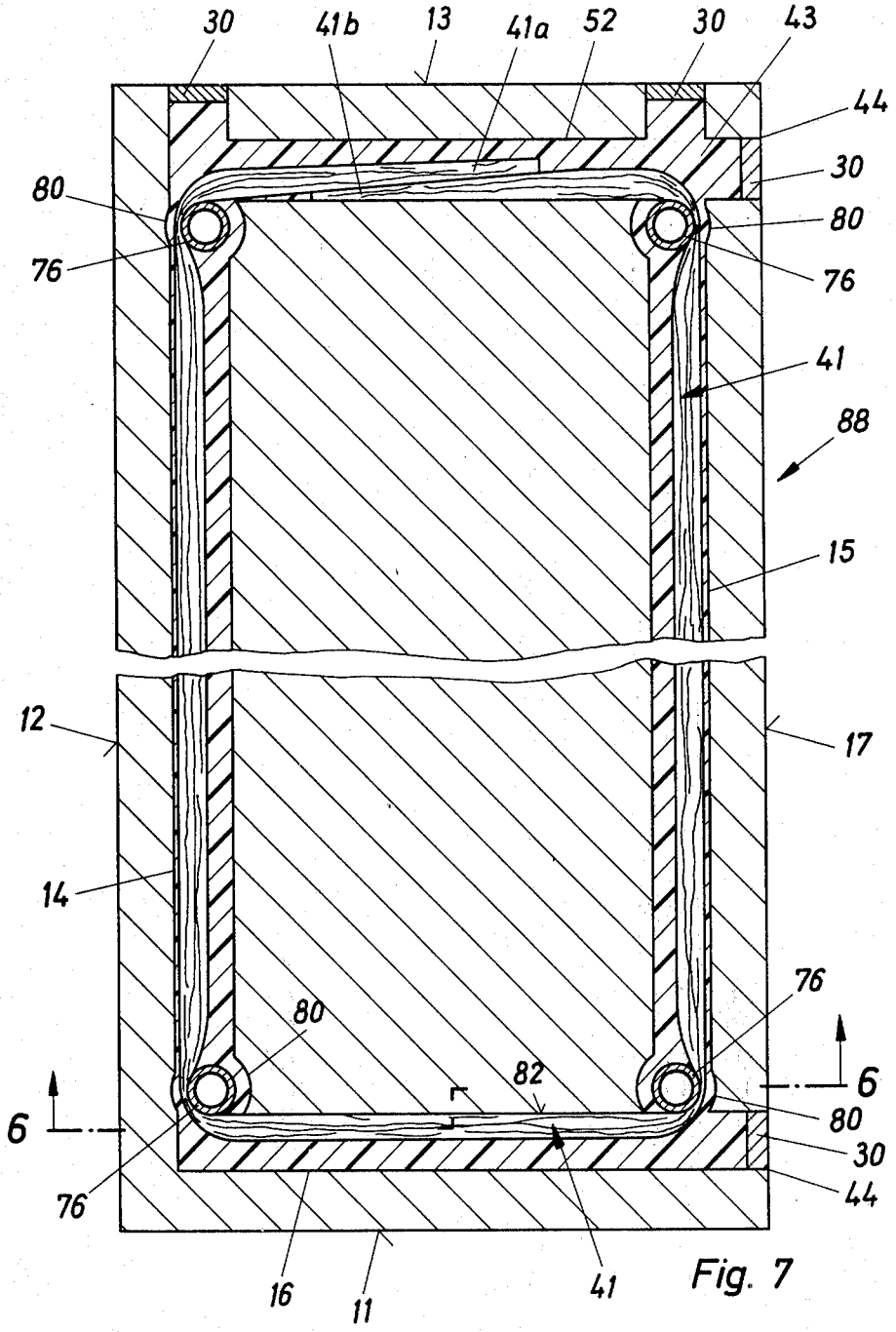
FIG. 7 is a horizontal section corresponding to FIG. 5, through a further embodiment of a step with four sleeves intended for an open-plan step.

FIG. 7 shows a step 88 differing from that of FIG. 5 only in that the slot 78 is replaced by a second transverse bore 52 with associated further sleeves 76, near the end 13. The bore 52 has single entry aperture 44, in the side 17. The ends 41*a* and 41*b* of the glass rovings are overlapped in this bore. All the bores are filled with plastics, as already described, and where appropriate are closed with plugs 30. This produces a structural component with excellent longitudinal and transverse reinforcement, the four corners of the said component providing reliable means for the attachment of connecting bolts or other parts which transfer forces. Steps of this kind can be employed particularly advantageously for so-called open-plan stairs in which the end 13 is spaced from the staircase wall. Wall ties are provided where appropriate and depending on the construction of the stairs. Such a component 88 may be part of a spatial load-bearing structure capable of absorbing all applied longitudinal and transverse stresses, more particularly torsional stresses. It is therefore suitable to function as a load-bearing structural component.

Figure 9:
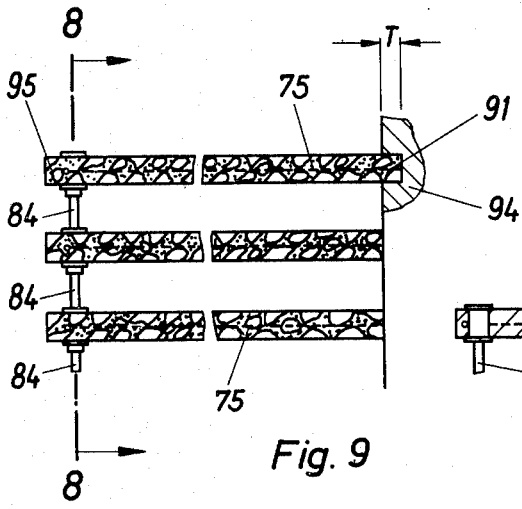
FIG. 9 is a section along the line 9—9 of FIG. 8 with the rear view of the bottom steps of the stairs.
Figure 8:
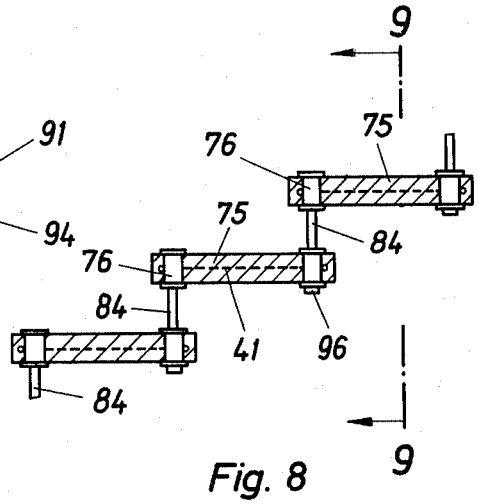
FIG. 8 is a diagrammatic side view of three steps, shown partially sectioned on the line 8—8 of FIG. 9.

FIGS. 8 and 9 illustrate a staircase employing steps according to the invention, more particularly as described with reference to FIGS. 5 and 6. Only three steps 75 are shown, the interiors of which can be constructed as previously described. One end 91 of each step is recessed to a small depth T into the staircase wall 94 and secured therein against twisting. At the free ends 95 the steps are connected by means of the connecting bolts 84 shown in FIG. 6 or by means of other similar connecting bolts of high-grade steel. These are appropriately screwed from below into screwthreaded sleeves 76 disposed in the next upper step and are fixed in each lower step by means of nuts 96 disposed in appropriate open-ended sleeves as is known for steps constructed of other materials. Such steps are highly stressed in torsion because the support at one free end by means of the bolts and securing to the staircase wall or other supporting structure involves a loading which corresponds to the reinforcing structure.

Figure 11:
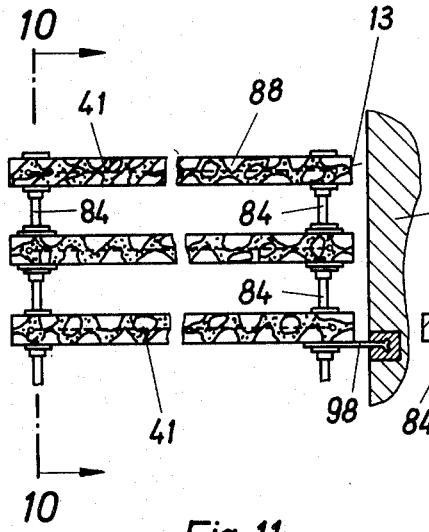
FIG. 11 is a section along the line 11—11 of FIG. 10 with a rear view of the bottom steps.
Figure 10:
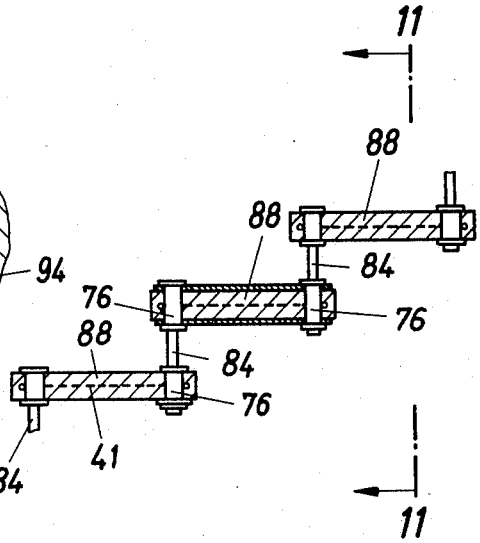
FIG. 10 is a section along the line 10—10 in FIG. 11 through three steps of open-plan stairs.

FIGS. 10 and 11 show stairs in which steps 88 according to FIG. 7 are connected to each other by means of the bolts 84. The end faces 13 are spaced from the staircase wall 94 as illustrated in FIG. 11. Wall ties 98, screwmounted to bolts 84 as is known for steps constructed of other materials, are inserted into the wall 94 only under certain individual steps. One row of bolts 84 is therefore provided on each side of the stairs. These steps are also subject to very high loadings, thus precluding the use without reinforcement of panels cut from natural rock such as marble or other materials which have no internal reinforcement. The reinforcement applied in accordance with the invention permits the use for such stairs of materials of attractive appearance, where such materials could hitherto not be used or only at great cost. The manufacturing costs can be confined to advantageous limits. The structural components according to the invention can also be used in stairs of other construction or for other similar applications.

I claim:

1. A building component, comprising;

a block of natural rock material presenting a styled appearance on substantially all surfaces thereof, and having two longitudinal bores, each extending into said material and through the same adjacent and along one side of the block, and a transverse bore extending through said material adjacent and along an end of the block and interconnecting the longitudinal bores; and elongate reinforcing means extending though the longitudinal and transverse bores and anchored to the natural rock material of the block for compressing the material to close hairline cracks of the material and for thereby reinforcing the block to enable it to be used as a load-bearing, structural element, while not interfering with its presenting its styled appearance.

2. A structural component according to claim 1, incorporating bearing members in the region of the corner points of the bores, the reinforcing means extending around said bearing members.

3. A structural component according to claim 2, in which the bearing members are disposed in bores substantially larger than the longitudinal bores.

4. A structural component according to claim 3, in which the longitudinal bores substantially centrally intersect the bores containing the bearing members while the or each transverse bore is situated tangentially with respect to the bearing members.

5. A structural component according to claim 2, in which at least one said bearing member is a mounting sleeve for a connecting bolt.

6. A structural component according to claim 1, in which the reinforcing means are disposed to prestress the component.

7. A structural component according to claim 1, in which each bore is open only at one end thereof.

8. A structural component according to claim 1, in which the reinforcing means comprises a wire rope.

9. A component according to claim 1, in which the reinforcing means comprises a metallic element longitudinally inserted in and extending substantially through each of the bores.

10. A structural component according to claim 1, in which the reinforcing means has end portions which have screws secured thereto, disposed longitudinally thereof, and carrying pre-stressing nuts which bear upon the material of the block.

11. A structural component according to claim 1, having plastics material disposed in the bores and embedding the reinforcing means.

12. A structural component according to claim 11, in which the reinforcing means comprises an elongate body of glass silk fibres successively extending through the several bores.

13. A structural component according to claim 1, in which the reinforcing means comprises plastics material filled with glass silk fibres disposed in random distribution, jointly extending without interruption through the longitudinal and transverse bores, said material filling said bores.

14. A structural component according to claim 1, in which the reinforcing means includes plastics material extending thoughout the bores and anchored therein by engagement with hairline cracks of the natural rock material.

15. A structural component according to claim 14, in which a curing shrinkage and an elongation of the plastics material are matched to a compressibility of the natural rock material of the block to provide a desired prestress in the component.

16. A structural component according to claim 14, in which the plastics material is a polyester resin.

17. A structural component according to claim 1, in which the longitudinal bores extend into the natural rock material of the block through only one end face of the block.

18. A structural component according to claim 6, in which the longitudinal bores have expanded open ends providing shoulders, the reinforcing means having end connector means bearing against the shoulders.

19. A structural component according to claim 1, having a second transverse bore, the reinforcing means extending through the same as well as through the first-mentioned bores.

20. A structural component according to claim 1, in which the transverse bore has a single, open end in a side face of the block, and a plug for closing the open end, said plug consisting of the same material as that of the rest of the block.

21. A stair element comprising a structural component according to claim 1, providing a step, the component having a connecting bolt disposed adjacent a narrow side thereof, and extending therefrom for connecting the step to an adjacent step.

22. A stair element according to claim 21, having supporting structure at one end of the step to secure it against twisting.

23. A stair comprising stair elements according to claim 21, and which are disposed to provide a rigid stair run of open-plan construction.

24. A stair according to claim 23, wherein each step has a connecting bolt anchored therein adjacent an end of a side of the step for connecting the step to an adjacent step.

25. A stair according to claim 24, wherein each step has a second bolt anchored therein adjacent another end of said side for connecting the step to the adjacent step.

26. A stair according to claim 1 in which the two longitudinal bores extend into a single end of the block and through the natural rock material to and into but not substantially beyond the transverse bore.

27. A stair according to claim 26 additionally including a sleeve inserted in the block, extending through at least one surface of the block, and intersecting a longitudinal bore at a location where the intersected longitudinal bore in the block extends into the transverse bore; and a support rod for the block, extending through and along the sleeve and secured thereto.

* * * * *